US010093441B2

(12) United States Patent
Berglin et al.

(10) Patent No.: US 10,093,441 B2
(45) Date of Patent: Oct. 9, 2018

(54) APPARATUS AND A METHOD FOR APPLYING DRINKING STRAWS TO PACKAGING CONTAINERS

(71) Applicant: Tetra Laval Holdings & Finance S.A., Pully (CH)

(72) Inventors: Michael Berglin, Malmö (SE); Lennart Olsson, Hjärup (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 15/550,443

(22) PCT Filed: Feb. 2, 2016

(86) PCT No.: PCT/EP2016/052151
§ 371 (c)(1),
(2) Date: Aug. 11, 2017

(87) PCT Pub. No.: WO2016/142104
PCT Pub. Date: Sep. 15, 2016

(65) Prior Publication Data

US 2018/0029737 A1 Feb. 1, 2018

(30) Foreign Application Priority Data

Mar. 11, 2015 (SE) ..... 1550289

(51) Int. Cl.
*B65B 61/20* (2006.01)

(52) U.S. Cl.
CPC ..... *B65B 61/205* (2013.01)

(58) Field of Classification Search
CPC ..... B65B 61/205
See application file for complete search history.

(56) References Cited

U.S. PATENT DOCUMENTS 4,293,369 A * 10/1981 Dilot ..... B65B 61/205 156/521
4,384,441 A * 5/1983 Maruyama ..... B65B 9/04 53/553

(Continued)

FOREIGN PATENT DOCUMENTS

EP 0121056 10/1984
EP 0305789 3/1989

(Continued)

OTHER PUBLICATIONS

International Search Report and Written Opinion from corresponding PCT Application No. PCT/EP2016/052151 dated Mar. 29, 2016 (11 pgs.).

(Continued)

*Primary Examiner* — Andrew M Tecco
*Assistant Examiner* — Praachi M Pathak
(74) *Attorney, Agent, or Firm* — Finnegan, Henderson, Farabow, Garrett & Dunner LLP

(57) ABSTRACT

The invention relates to an apparatus and a method for applying drinking straws to packaging containers. A drinking straw carrier is adapted to keep the drinking straw towards the wall of the packaging container while moving along a lengthwise direction of the drinking straw, from an application position to the leaving position. The drinking straw carrier comprises a rotatable roller having an axis of rotation arranged substantially perpendicular to the lengthwise direction of the drinking straw, and said roller is adapted to rotate in contact with the drinking straw.

9 Claims, 7 Drawing Sheets

(56) References Cited

U.S. PATENT DOCUMENTS

| | | | | | |
|---|---|---|---|---|---|
| 4,572,758 | A * | 2/1986 | Wild | B65B 61/205 | 156/256 |
| 4,584,046 | A * | 4/1986 | Geyssel | B65B 61/205 | 156/353 |
| 4,584,819 | A * | 4/1986 | Hakansson | B65B 61/205 | 53/133.1 |
| 4,903,458 | A * | 2/1990 | Hakansson | B65B 61/205 | 156/443 |
| 4,969,308 | A * | 11/1990 | Hakansson | B65B 61/205 | 53/133.1 |
| 5,037,366 | A * | 8/1991 | Yokoyama | B65B 61/205 | 493/84 |
| 5,676,629 | A * | 10/1997 | Andersson | B65B 61/184 | 156/566 |
| 5,979,142 | A * | 11/1999 | Kraft | B65B 61/205 | 53/133.1 |
| 6,282,865 | B1 * | 9/2001 | Bergstrom | B65B 61/205 | 53/128.1 |
| 6,526,725 | B1 * | 3/2003 | Williams | B65B 61/205 | 493/379 |
| 8,870,729 | B2 * | 10/2014 | Lindback | B65B 61/205 | 493/84 |
| 9,527,618 | B2 * | 12/2016 | Wild | B65B 61/205 | |
| 2001/0002532 | A1 * | 6/2001 | Murphy | B65B 61/205 | 53/445 |
| 2010/0300040 | A1 * | 12/2010 | Lindback | B65B 61/205 | 53/133.1 |
| 2011/0036053 | A1 * | 2/2011 | Wild | B65B 61/205 | 53/133.1 |
| 2018/0029737 | A1 * | 2/2018 | Berglin | B65B 61/205 | |

FOREIGN PATENT DOCUMENTS

| | | |
|---|---|---|
| EP | 1042172 | 10/2000 |
| SE | 1451136-4 | 9/2014 |
| SE | 1451542-3 | 12/2014 |
| WO | WO 98/51572 | 11/1998 |
| WO | WO 2016/045921 | 3/2016 |
| WO | WO 2016/096379 | 6/2016 |

OTHER PUBLICATIONS

Office Action issued in corresponding Swedish Application No. 1550289-1 dated Oct. 21, 2015 (4 pgs.).

* cited by examiner

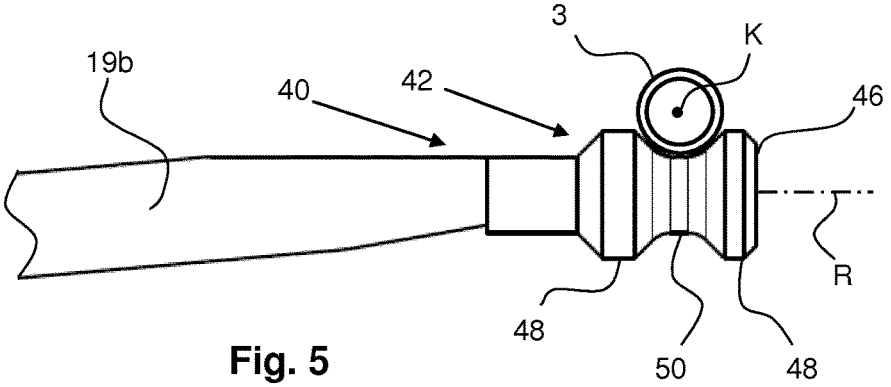
Fig. 5
FIG 7
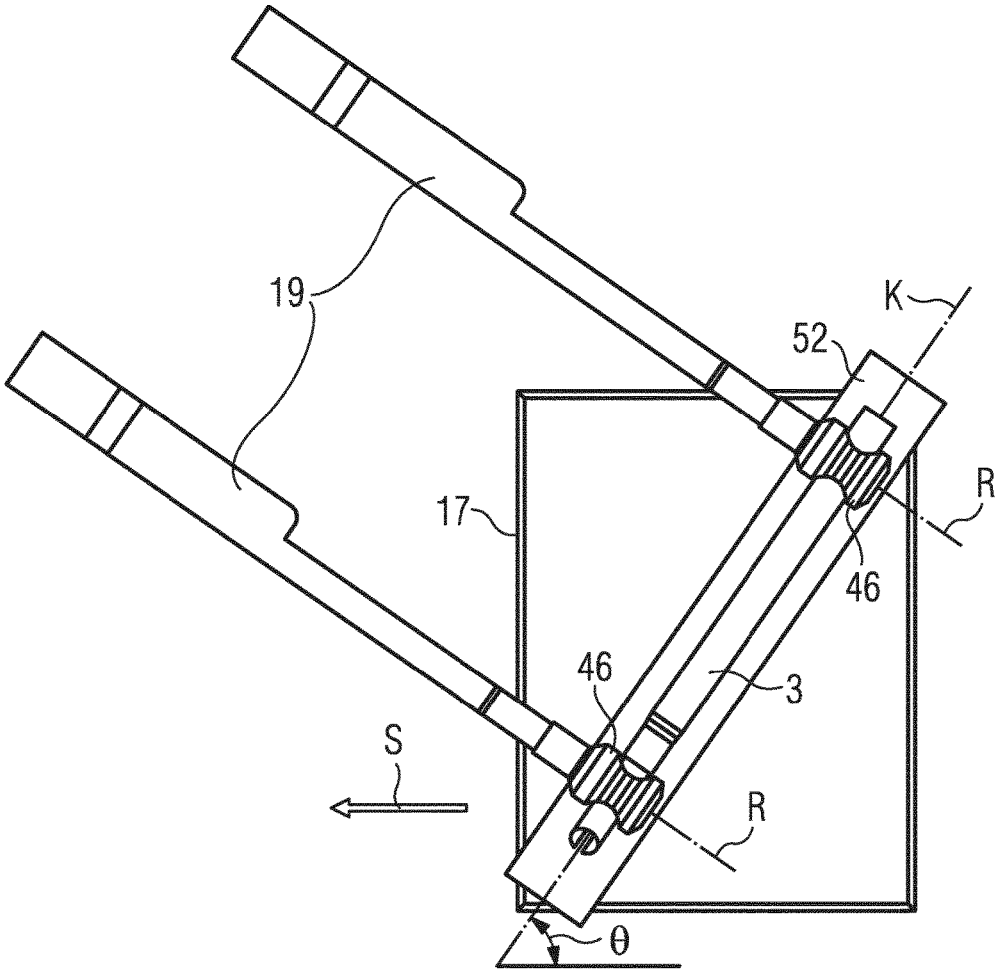

APPARATUS AND A METHOD FOR APPLYING DRINKING STRAWS TO PACKAGING CONTAINERS

This is a National Phase of PCT Application No.PCT/EP2016/052151, filed Feb. 2, 2016, which claims the benefit of SE Application No. 1550289-1 filed Mar. 11, 2015, all of which are incorporated herein by reference.

TECHNICAL FIELD

The present invention relates to an apparatus and a method for applying drinking straws to packaging containers.

BACKGROUND ART

Many packaging containers for liquid food are manufactured in so-called portion volumes, intended to be consumed direct from the package. The majority of these packages are provided with drinking straws in a protective envelope which is secured to the one side wall of the packaging container. The packaging containers, which are often parallelepipedic in shape, are manufactured from a laminate with a core of paper or paperboard, with layers of thermoplastics and possibly aluminum foil. On the one wall of the packaging container—most often the top wall—a hole has been punched out in the core layer and this hole is covered by the other layers of the laminate, which makes it possible to penetrate the hole with the drinking straw which accompanies the packaging container, and hereby consume the drink enclosed in the package.

There have long been machines which apply drinking straws in their protective envelopes to packaging containers which are conveyed through the machine. Such a machine, i.e. a drinking straw applicator, is, for example, described in the European Patent Specification EP-1,042,172. The applicator functions in that a belt of continuous drinking straw envelopes with drinking straws is guided in towards and surrounds a drive means. Adjacent the drive means, there are devices for severing the drinking straw belt into individual drinking straws enclosed in a protective envelope, as well as devices for applying the drinking straw to one side wall of the packaging container, the packaging container being advanced on a conveyor through the machine. Prior to the moment of application, the envelope drinking straw is provided with securement points. The securement points may, for example, consist of hot melt, which is molten glue which glues the drinking straw envelope in place and retains it when the glue has hardened.

Today straw applicators may operate in ultra high speeds, handling approximately 40,000-50,000 packages/hour. The Swedish patent application No. 1451136-4 describes an ultra high speed straw applicator.

One issue with straw applicators, irrespective of operational speeds, is the difficulty of retaining the drinking straw on the wall of the packaging container at exactly the same position, with an application device, while at the same time conveying the packaging container through the straw applicator. If the application device and the conveyor, on which the packaging container is transported, become un-synchronised, even just slightly, the drinking straw will lose its position on the packaging wall and the glue will smear. In most cases the end result will only be a less attractive packaging container, but in a worst case the bonding strength between the drinking straw and the packaging container is considerably reduced, with an increased risk that the drinking straw will detach from the packaging container during handling. The Swedish patent application No. 1451542-3 describes a solution in which the drinking straw is not moved, relative the packaging container, in the direction of the conveying direction, i.e. in the direction in which the packaging container is moved during application. The movement of the application device is compensated such that the application device will, during the application, follow the drinking straw in the lengthwise straw direction.

Another issue that may still exist is that the drinking straw is undesirably moved, relative to the packaging container, in the lengthwise direction of the drinking straw. Such movement may cause smear of the glue and there will be a risk that the drinking straw is not properly attached to the packaging container. The movement is caused by friction between the envelope of the drinking straw and the contact surface of application device.

OBJECT OF THE INVENTION

One object of the present invention is therefore to provide an apparatus for applying drinking straws to packaging containers, which apparatus improves the positioning and retaining of the drinking straw in a correct position. According to a first aspect of the invention, the object is solved by an apparatus for applying drinking straws to packaging containers. Said apparatus comprises a drive means adapted for conveying drinking straws wrapped in protective envelopes to a picking position. It further comprises a first conveyor adapted for conveying packaging containers, at a substantially constant velocity, along a packaging container moving direction. The apparatus further comprises an application device which comprises at least one applicator arm, which applicator arm comprises a drinking straw carrier adapted to carry a drinking straw. Said at least one applicator arm is adapted to pick a drinking straw from the drive means at the picking position and carry, with the drinking straw carrier, the drinking straw to an application position where the drinking straw is adapted to come into contact with a wall of the packaging container, and further to a leaving position where the at least one applicator arm leaves the drinking straw on the packaging container. The drinking straw carrier is adapted to keep the drinking straw towards the wall of the packaging container while moving along a lengthwise direction of the drinking straw, from the application position to the leaving position, and the drinking straw carrier comprises a rotatable roller having an axis of rotation arranged substantially perpendicular to the lengthwise direction of the drinking straw, which roller is adapted to rotate in contact with the protective envelope and drinking straw.

In one or more embodiments the roller is rotatably journalled on a shaft of the applicator arm and is adapted to rotate due to friction from the protective envelope and drinking straw.

In one or more embodiments friction between the shaft and the roller is adapted to be less than friction between the protective envelope and an outer contact surface of the roller, wherein the friction between the protective envelope and the outer contact surface of the roller is less than between the protective envelope and the wall of the packaging container, such that the roller is adapted to start rotating upon contacting the envelope and drinking straw, and such that the drinking straw will not be displaced in relation to the packaging container.

Furthermore, in one or more embodiments the roller is made of a plastic material with a low coefficient of friction and a high resistance to abrasion.

In one or more further embodiments the roller is shaped as an axisymmetric, concave cylinder adapted to carry the drinking straw with a concave centre bounded by two end flanges.

In one or more embodiments the at least one applicator arm has a base end point arranged for eccentric, substantially circular rotation round a rotation point, the rotation point being connected to a drive unit adapted to provide a rotational velocity. The applicator arm comprises a spring-loaded pivot point around which at least an outer portion of the applicator arm can rotate. Said outer portion comprises the drinking straw carrier. The application device and the first conveyor are arranged such in relation to each other that, upon application of the drinking straw towards the wall of the packaging container, at the application position, the outer portion of the applicator arm will be forced to rotate around the spring-loaded pivot point thereby creating a force pushing the drinking straw towards the wall of the packaging container.

According to a second aspect of the invention, the object is solved by a method for applying drinking straws to packaging containers. Said method comprises the step of conveying drinking straws wrapped in protective envelopes to a picking position by means of a drive means. The method further comprises the step of conveying the packaging containers by a first conveyor at a substantially constant velocity, along a packaging container moving direction. The method further comprises the step of picking a drinking straw with envelope from the drive means at the picking position by means of an application device which comprises at least one applicator arm, which applicator arm comprises a drinking straw carrier adapted to carry a drinking straw. The method further comprises the step of carrying the drinking straw, with the drinking straw carrier, to an application position where the drinking straw is adapted to come into contact with a wall of the packaging container, and further to a leaving position where the at least one applicator arm leaves the drinking straw on the packaging container. The method further comprises the step of keeping the drinking straw towards the wall of the packaging container, with the drinking straw carrier, while moving the drinking straw carrier along a lengthwise direction of the drinking straw, from the application position to the leaving position, said drinking straw carrier being a rotatable roller having an axis of rotation arranged substantially perpendicular to the lengthwise direction of the drinking straw and said roller being arranged to rotate in contact with the drinking straw.

In one or more embodiments the at least one applicator arm has a base end point arranged for eccentric, substantially circular rotation round a rotation point, the rotation point being connected to a drive unit adapted to provide a rotational velocity. The applicator arm comprises a spring-loaded pivot point around which at least an outer portion of the applicator arm can rotate, said outer portion comprises the drinking straw carrier. The application device and the first conveyor are arranged such in relation to each other that, upon application of the drinking straw towards the wall of the packaging container, at the application position, the outer portion of the applicator arm will be forced to rotate around the spring-loaded pivot point thereby creating a force pushing the drinking straw towards the wall of the packaging container. Said method comprises the step of moving the drinking straw carrier from the application position to the leaving position, in the packaging container moving direction, maintaining a velocity in that direction being equal to the constant velocity of the first conveyor, thereby keeping the drinking straw at the same position on the wall of the packaging container, by accelerating or decelerating the rotational velocity of the drive unit to compensate for changes in velocity of the drinking straw carrier, in the packaging container moving direction, due to a changing velocity component, in the packaging container moving direction, of the eccentric rotation round the rotation point and the rotation of at least the outer portion of the applicator arm around the pivot point.

BRIEF DESCRIPTION OF THE ACCOMPANYING DRAWING

One embodiment of the present invention will now be described in greater detail hereinbelow, with reference to the accompanying drawing, in which:

FIG. 5 is a schematic illustration of a drinking straw carrier and a drinking straw.

FIG. 7 is a schematic view from the side of a packaging container, applicator arms and a drinking straw.

The drawings show only those details essential to an understanding of the present invention, and the remaining parts of the apparatus, which are well-known to a person skilled in the art, have been omitted.

DESCRIPTION OF PREFERRED EMBODIMENT

Figure 1:
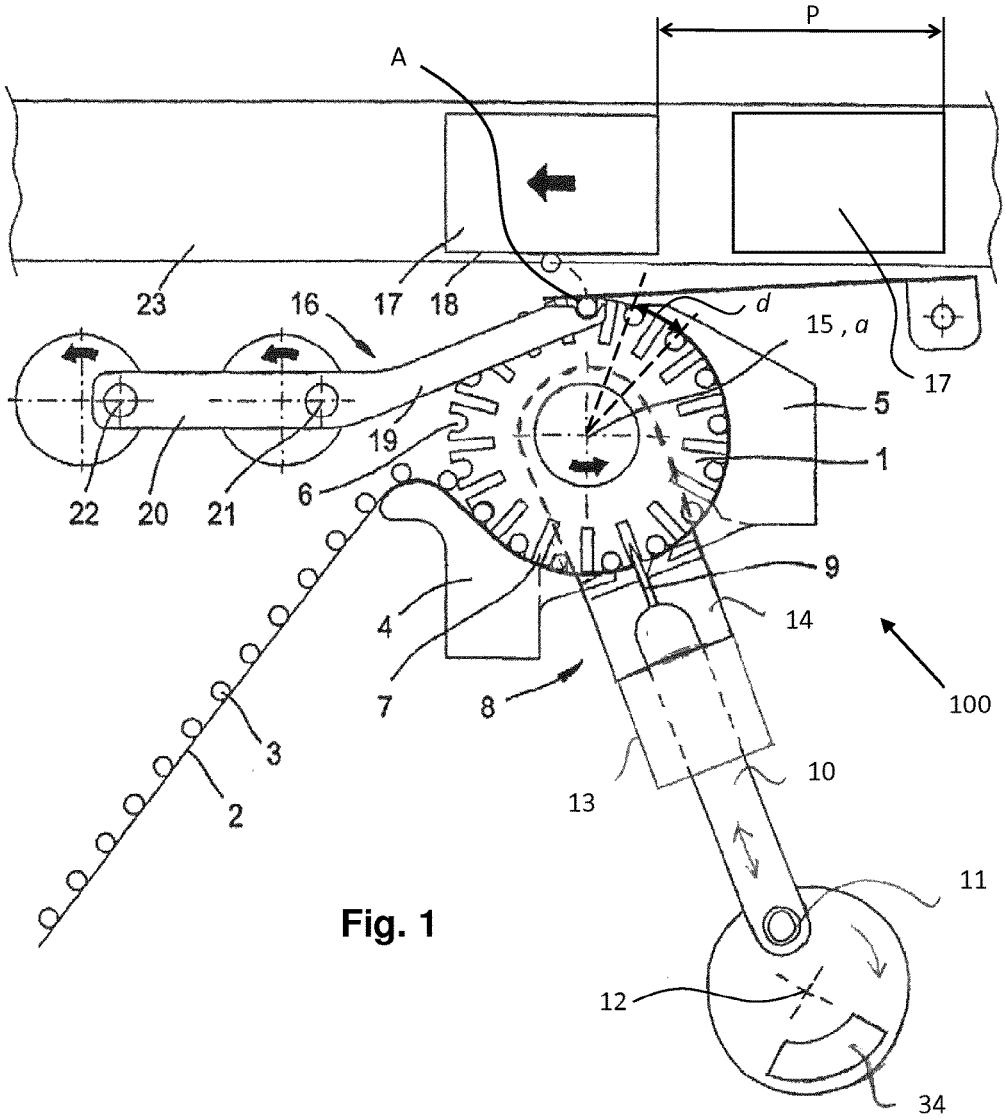
FIG. 1 is a schematic illustration, in a plane view.

FIG. 1 shows some of the central parts of the apparatus 100. The apparatus comprises a drive means 1, a so-called feed wheel. A continuous belt 2 of drinking straws 3, wrapped in protective envelopes, is advanced to the drive means 1. The belt 2 of drinking straws 3 is advanced via guides (not shown) as well as guides 4 and 5 surrounding the drive means 1 and which retain the belt 2 of drinking straws 3 against the drive means 1. The drive means is adapted to rotate by means of a first motor (not shown), e.g. a servo motor, of a drive unit. The servo motor is preferably arranged displaced from the drive means 1, and is connected to a centre shaft 15 of the drive means 1 via a belt and/or cogwheels/gears (not shown).

On its circumferential surface, the drive means 1 has a number of recesses 6 which are each intended for one drinking straw 3. The number of recesses 6 on the drive means 1 depends on the thickness and design of the drinking straw 3, and the pitch between straws in the belt. In a conventional belt of straight and telescopic straws the pitch is e.g. 15 mm, whereas for U-shaped straws the pitch is e.g. 22 mm.

Between each recess 6 on the circumferential surface of the drive means 1, there is disposed a groove 7. The groove 7 is intended to receive a knife 9 of a separation device 8 for separating individual drinking straws 3, and their envelopes, from the belt 2.

The separation device 8, for separating the drinking straws 3, comprises the knife 9, which knife 9 is fixedly mounted in a holder 10. The holder 10 is journalled on an eccentric shaft 11. A centre shaft of a disc 12, to which the eccentric shaft 11 is fixed, is driven by the first servo motor via the same belt and/or cogwheels/gears driving the drive means 1. Hence, the separation device 8 and the drive means 1 are mechanically interconnected and both the rotation of the drive means 1 and the motion of the separation device 8 are driven by the first servo motor. Further, the knife holder 10 is journalled in an axial bearing 13, which bearing is fixedly attached to a rod 14 rotatably journalled around the centre shaft 15 of the drive means 1.

The apparatus 100 further includes an application device 16 for applying a drinking straw 3 on one side wall 18 of a packaging container 17. The application device 16 comprises two applicator arms 19. With two cooperating applicator arms 19, a more reliable and efficient placing of the drinking straws 3 on the side wall 18 of the packaging containers 17 will be obtained.

The arms 19 are oriented above one another and are united by means of a bracket 20, which may in principle consist of an extension of the applicator arms 19. The bracket 20 is journalled in two eccentric shafts 21, 22 which have the same eccentricity. The drive means 1 is provided with parallel grooves (not shown) along its circumference. The applicator arms 19 are arranged to move in these grooves, and at at least one point be arranged in between the drive means and a separated straw 3, to be able to pick the straw 3 and carry it towards the side wall 18 of a packaging container 17. The application device 16 is driven by a second motor (not shown), e.g. a servo motor, of the drive unit. The second servo motor drives the application device 16 via a belt and/or cogwheels/gears.

The apparatus 100 further comprises a first, lower conveyor 23, passing by the drive means 1, for conveying the packaging containers 17 which are to be supplied with drinking straws 3. The conveyor 23 may consist of an endless, driven belt. Only a portion of the conveyor is shown in FIG. 1.

Figure 2:
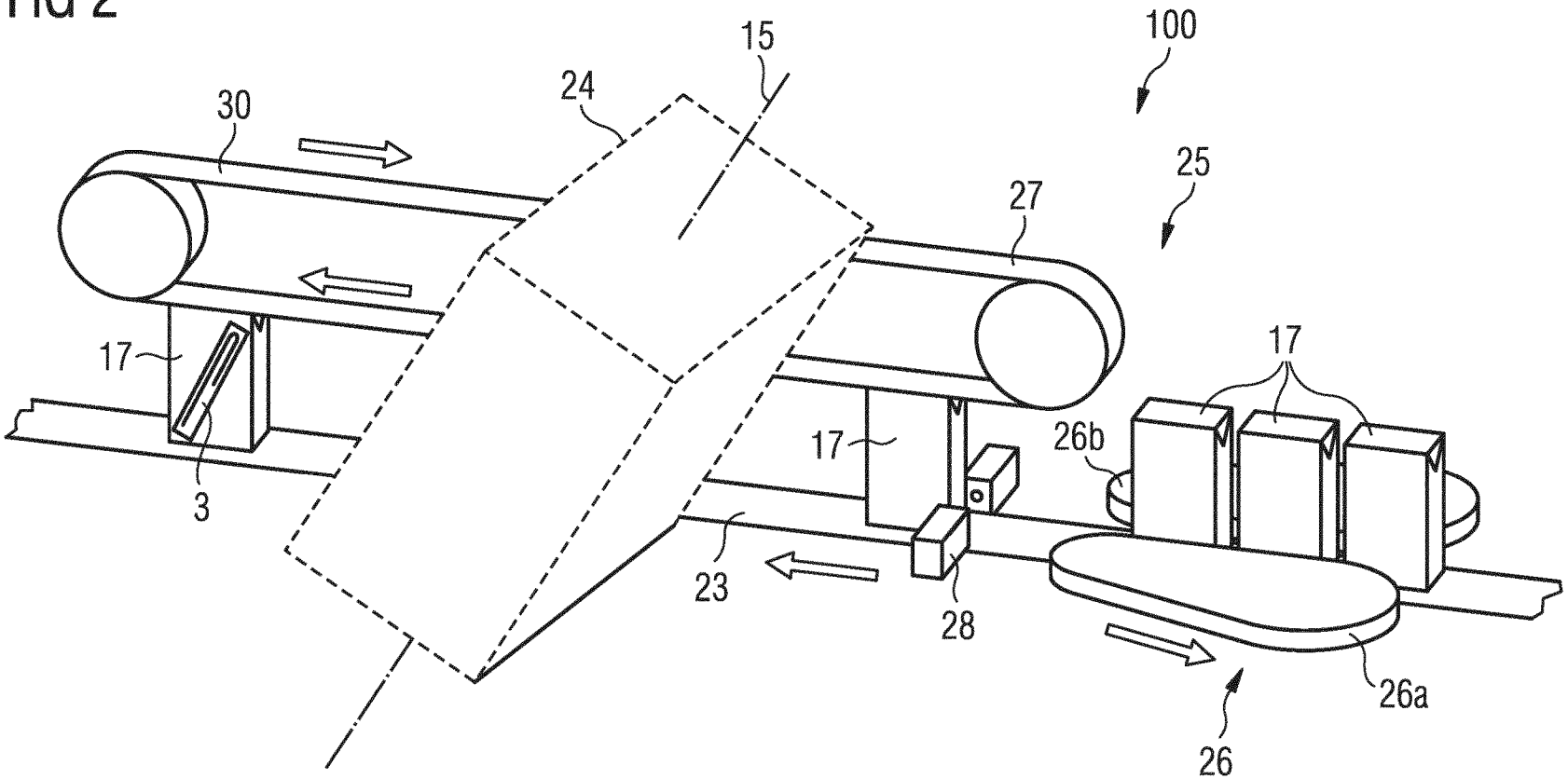
FIG. 2 is a schematic illustration in a perspective view of the apparatus according to the present invention.

The drive means 1, the application device 16 and the separation device 8 are designed such that it may be variably inclined in relation to the conveyor 23. In this way the packaging containers 17, which are advanced with their bottom surface bearing on the horizontal conveyor 23, will have the drinking straws 3 placed in the desired angle of inclination on the side wall 18. The inclination depends on both the volume of the packaging container 17 and on the size and shape of the drinking straw 3. FIG. 2, showing the entire apparatus 100, illustrates the inclination. For simplification the drive means 1, the separation device 8 and the application device 16 are shown as a box 24 drawn with dashed lines. An axis illustrating the inclination of the centre shaft 15 of the drive means 1 is shown, and a packaging container is also shown having a straw applied with a similar inclination.

The drive means 1, which is disposed to rotate continuously during operation, is the central unit in the apparatus 100, see FIG. 1 again. It is the drive means 1 which transports the drinking straws 3 round from when the continuous belt 2 of drinking straws 3 wrapped in protective envelopes reaches the apparatus 100 via a number of guides (not shown), around the circumferential surface of the drive means 1, past the separation device 8 to the application device 16. The drive means 1 moves with a gear ratio from the first servo motor which depends on the number of recesses 6 on the circumferential surface of the drive means 1. The drive means 1 rotates one division, i.e. one recess 6 for each packaging container 17 which passes the drive means 1. For example, a drive means 1 for straight drinking straws 3 may have a gear ratio of 17:1 and a drive means 1 for U-shaped drinking straws may have a gear ratio of 12:1.

The separation device 8, for separating a straw 3, in its envelope, from the rest of the belt 2 executes two movements during each separation cycle. On the one hand, the knife 9 reciprocates radially in relation to the drive means 1 and into the groove 7 in order to be able to separate one drinking straw 3 from the belt 2. On the other hand, the separation device 8 must accompany the continuously rotating drive means 1 during that time when the separation cycle is in progress. These two movements are simultaneously achieved by means of the eccentricity of the shaft 11 and the alternating, pivoting motion (counterclockwise and clockwise) of the rod 14 around the shaft 15 of the drive means 1.

Once the separation cycle is completed and the knife 9 has severed one drinking straw 3, in its protective envelope, from the continuous belt 2, the separation device 8 returns to its starting position and begins a new separation cycle.

The first conveyor 23 moves tangentially in relation to the drive means 1 and conveys the packaging containers 17, which are to be provided with drinking straws 3, past the drive means 1. The first conveyor 23 moves at a speed which is synchronised with the speed of the drive means 1, the separation device 8 and the application device 16. Before the separated straws 3 are picked by the application device 16, their envelopes have been provided, on one of their side surfaces, with securement points, preferably two in number, which may, for example, consist of glue, preferably so called hot melt. The securement points are to glue in place and, once the hot melt glue has set, retain the drinking straw 3 in its protective envelope against the side wall 18 of the packaging container 17.

The application device 16 for applying drinking straws 3 on the side walls 18 of the packaging containers 17 describes, by means of the two eccentric shafts 21, 22, a circular or alternatively elliptic movement so that the arms 19 move in towards the drive means 1 and entrap a drinking straw 3. The drinking straw 3 is moved by the rotating movement towards the side wall 18 of the packaging container 17 and is kept in position by means of the securement points. As a result of the second servo motor and requisite gear ratios, the applicator arms 19 now move at the same speed at which the conveyor 23 (and thereby also the packaging container 17) moves, and the applicator arms 19 accompany, in their rotating movement, the packaging container 17 and the conveyor 23 a short distance before the rotational movement recuperates the applicator arms 19 back to their starting position where they begin a new application cycle.

By means of FIG. 2 more parts of the apparatus 100 will be described. The apparatus 100 comprises a packaging container sensing device 28 for sensing a packaging container 17 passing on the first, lower conveyor 23. The sensing device 28 comprises any conventional type of sensor, e.g. a photocell arrangement, able to detect a passing packaging container. The sensing device 28 is arranged upstream the drive means 1. The photocell arrangement is in two parts, said parts being aligned and facing each other in a direction perpendicular to the transport direction of the lower conveyor 23. The two parts are shown in FIG. 2.

The sensing device 28 is positioned at a fixed distance from the position where the application device 16 applies the straw 3 onto the packaging container 17. Passage of a packaging container sends a signal to a control device (not shown) of the apparatus, e.g. a PLC, which will time the movements of the drive means 1, separation device 8 and the application device 16 based on the detection of the packaging container being transported on the lower conveyor 23. The timing is made by accelerating or decelerating the first and second servo motors of the drive unit and in that way the straw will be applied at a correct position on the packaging container once the packaging container reaches the application device 16. Hence, with regard to the sensing device 28 and the control device any distance between the packaging containers can be dealt with, e.g. if the distance between succeeding packaging containers is not exactly equal, or even highly differs between two succeeding packaging containers, it will still work since the application cycle is individually timed for each passing packaging container by acceleration or deceleration of the first and second servo motors.

Figure 3:
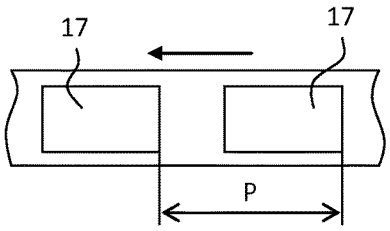
FIG. 3 is a schematic illustration, in a top view, of two packaging containers and a conveyor.

In FIG. 2 the drive means 1, the application device 16, the separation device 8 and the associated servo motors etc. are shown, for simplification, as a box 24 in dashed lines. FIG. 2 further shows the previously described first conveyor 23 and the sensing device 28 being parts of the apparatus of the present invention. The apparatus 100 further comprises a pitch control device 25 for controlling the pitch, i.e. the distance, between succeeding packaging containers 17 being fed to the drive means 1. The definition of pitch is illustrated by means of FIG. 3. The pitch, denoted P, is the distance between similar points on two succeeding packaging containers 17. In the figure the pitch P is measured from a back surface of a leading packaging container to the back surface of a trailing, or successive, packaging container.

The pitch control device 25 is arranged upstream the drive means 1 and comprises a packaging container deceleration device 26, e.g. a belt brake, and a second, upper conveyor 27.

The deceleration device 26, being a belt brake in this embodiment, is arranged upstream the sensing device 28 and the second upper conveyor 27. The belt brake has belts 26*a*, 26*b* on each side of the lower conveyor 23. The belts 26*a*, 26*b* are partly running in parallel with the transported packaging containers 17 in such a way that said belts are adapted to come into contact with two opposed side walls of each packaging container, and decelerate and transport the packaging container at a velocity being less than that of the conveyor 23. Hence, the belts 26*a*, 26*b* are adapted to create higher friction against the packaging container 17 than the friction between the packaging container 17 and the lower conveyor 23. The packaging container will thus slide against the lower container 23 and queue up, or line up, in the belt brake 26.

The second, upper conveyor 27 is arranged above a portion of the first, lower conveyor 23, and is adapted to help transporting the packaging containers by supporting their top surface. The upper conveyor also keeps track of the position of the packaging container in relation to the application device, in that a third motor (not shown), for example a servo motor, used for driving the conveyor, is used, based on the servo motor speed, to calculate the time before the packaging container passes the application device. The upper conveyor 27 comprises a belt 30 adapted to bear against the top surface of the packaging container. The upper conveyor 27 is positioned such that it will come into contact with a packaging container while the packaging container is about to leave the belt brake 26. This position, where the upper conveyor 27 contacts the packaging container 17, is upstream the sensing device 28. The distance between the packaging container transport surface of the lower conveyor 23 and the lower end of the belt 30 of the upper conveyor 27 equals the packaging container height, and can be adjusted to fit different packaging container sizes. Preferably, for this reason, the upper conveyor 27 is displaceable in relation to the lower conveyor 23.

The pitch control device 25 operates as follows. The velocities of the first, lower conveyor 23 and the second, upper conveyor 27 are set substantially equal. The velocity of the belts 26*a*, 26*b* of the belt brake 26 is set to be slower. Hence, as mentioned above, the packaging containers 17 will queue up once reaching the belt brake 26. Upon advancement of the packaging containers 17 through the belt brake 26, the packaging containers 17 will reach the downstream end of the belt brake 26. Just before leaving the belt brake 26 the packaging container will reach the upstream end of the upper conveyor 27. The upper and lower conveyors 23, 27 will then "pick" the packaging container 17 at the downstream end of the belt brake 26, and change its velocity to that of the upper and lower conveyors 23, 27. Due to the lower velocity of the belt brake 26, compared to that of the upper and lower conveyors 23, 27, the "picking" action will create a distance, pitch P (FIG. 3), between succeeding packaging containers 17. The packaging container 17 will proceed to the sensing device 28 which is positioned at a fixed distance from the position where the application device 16 applies the straw 3 onto the packaging container 17. The control device will time the movement of the drive means 1, separation device 8 and the application device 16 based on the detection of a packaging container, such that the straw 3 will be applied at a correct position on the packaging container once the packaging container reaches the application device 16. This is to adjust to variations in the pitch which may naturally still exist.

A pitch set point value $P_s$ is set (not shown). This is the ideal pitch for the capacity in terms of velocity and acceleration, for which the apparatus is designed. The pitch set point value $P_s$ will be the same irrespective of the size of the packaging container, for sizes within an operational range of the apparatus. This means that the pitch will be the same for all packaging containers to be processed through the apparatus. With a fixed, pre-set pitch vibrations in the apparatus can be considerably minimised since the mechanics can be dimensioned and balanced for said pitch. This is further described in the Swedish patent application No. 1451136-4.

The drive unit is driven at a substantially constant speed, i.e. with a minimum of acceleration variations, as much as possible minimizing frequent, considerable accelerations and decelerations of the servo motors of the drive unit. The speeds of the servo motors are set by the apparatus' control device, which also controls the synchronization of the movements of the drive means 1, the separation device 8 and the application device 16, as well as of the conveyors transporting the packaging containers. If the pitch is set to 80 mm the drive unit will not go down into stop/standby mode (standstill of drive unit) if there is a packaging container coming within a pitch of 130 mm. It will decelerate some.

So far the general function of the apparatus 100 has been described. In the following the application device 16 will be described in more detail with reference to FIGS. 4-8. The motion of the application device 16 will also be described in more detail.

Figure 4:
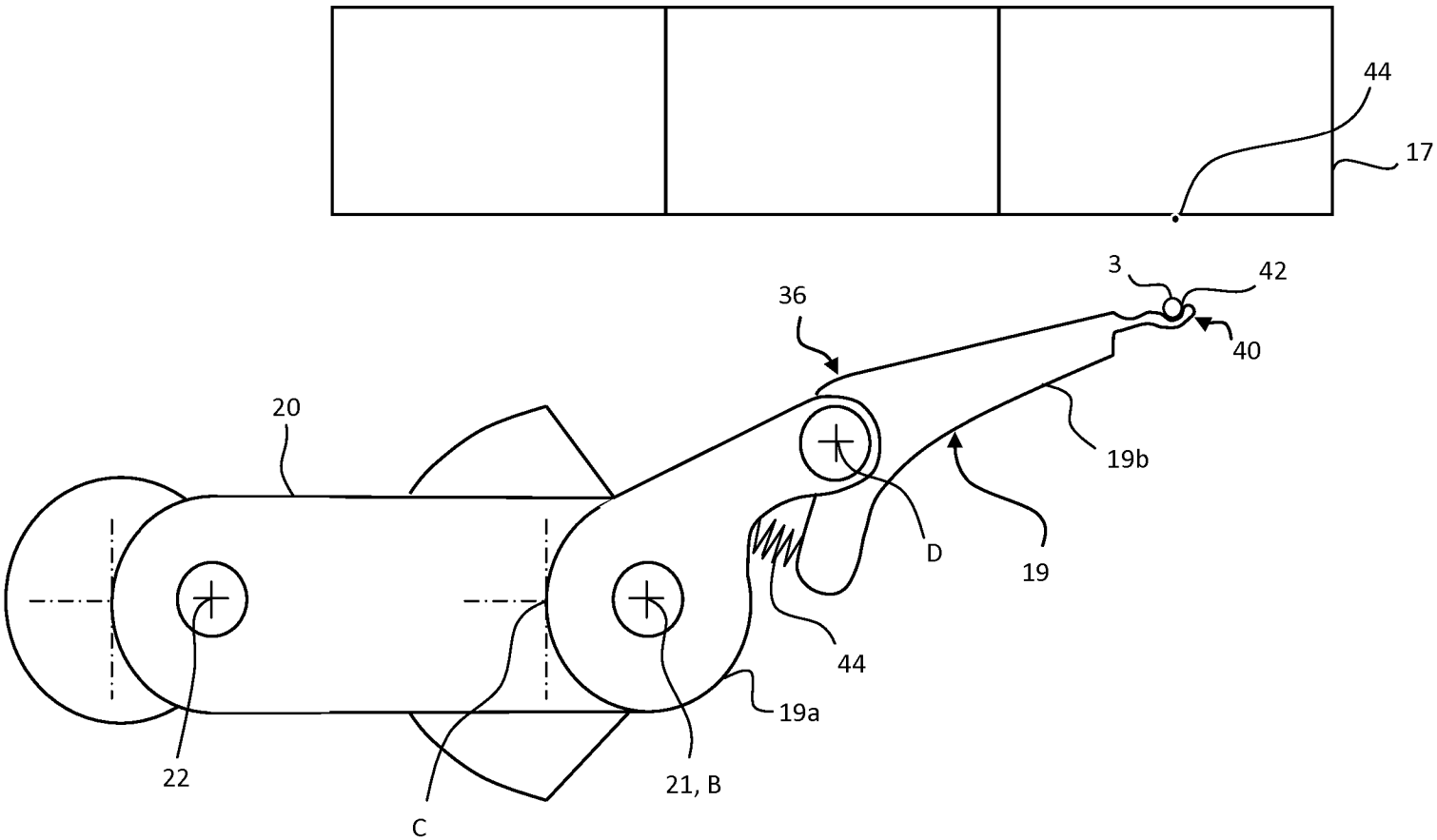
FIG. 4 is a schematic illustration, in a top view, of the application device and some packaging containers.

As mentioned above the application device 16 comprises a pair of applicator arms 19 oriented above one another and united by means of a bracket 20. Only the uppermost applicator arm is shown in FIG. 4. The bracket 20 is journalled in two eccentric shafts 21, 22 which have the same eccentricity. A base point B of the arms 19 are journalled in a first 21 of the two eccentric shafts, and hence the arms 19 will be adapted for eccentric, substantially circular rotation round a rotation point C. Said rotation point C is connected to the drive unit, and particularly to a second motor (not shown), e.g. a servo motor. The servo motor will, during operation, provide rotational movement such that the arms 19, due to the eccentric shaft, are moved along the circular path. This movement makes the application device, with its applicator arms 19, perform an application motion cycle in which the application device picks a drinking straw 3 from the drive means 1 (shown in FIG. 1) at a picking position, and carries it to a packaging container 17, which packaging container is passing by on the first conveyor 23. The drinking straw comes into contact with the packaging container in an application position, and the applicator arm 19 follows the moving packaging container for a distance, from the application position to a leaving position, at which leaving position the application device leaves the drinking straw 3 and returns to the drive means 1 for picking a successive drinking straw 3.

As mentioned the pair of applicator arms 19 is able to pick a drinking straw 3 from the drive means 1. The drive means 1 in this embodiment is cylindrical and the drinking straws 3 in their envelopes are kept on the outer circumferential surface. The straw extension is parallel to the axial axis $\alpha$ of the cylindrical drive means 1. The drive means rotates in order to advance drinking straws 3 to a picking position A (shown in FIG. 1), where the applicator arms 19 can pick it. In order to advance a drinking straw 3 the drive means 1 is rotating one division around the axis a (FIG. 1). One division is the rotation corresponding to the circumferential distance d between two successive drinking straws kept on the drive means 1. The motion cycle corresponds to the movement needed for rotating one division.

In this embodiment one drinking straw 3 is advanced per division and is made available at the picking position A where the application device 16, and i.e. the applicator arm 19, can pick it. The time available for rotating one division depends on the pitch P between the packaging containers. Since the speed of the first conveyor 23 is kept constant, the time period for bringing another packaging container in position for straw application will depend on the pitch. As mentioned above the pitch between successive packaging containers is detected by the sensing device 28, and the motion of the drive means 1 is adapted to fit the corresponding pitch.

Each applicator arm 19 comprises two portions (see FIG. 4), a first portion 19*a* and an outer, second portion 19*b*. The first portion 19*a* comprises the base point B, which, as mentioned above, is journalled on the eccentric shaft 21. The second portion 19*b*, being the outer portion, is in a first end 36 rotatably journalled in the first portion 19*a*. The rotation is made around a pivot point D. The second portion 19*b* has a second end 40, remote to the first end 36, which has drinking straw carrier 42 for carrying a drinking straw 3. The drinking straw carrier 42 is here shown very simplified, and a more detailed description will be given in relation to FIG. 5. The rotation around the pivot point D is spring-loaded by a compression spring 44 extending from the first end 36 of the second portion 19*b* to the first portion 19*a*. The second portion 19*b* can rotate in a clockwise direction around the pivot point D and compress the spring 44.

The drinking straw carrier 42 as well as a portion of the second portion 19*b* of the applicator arm 19 is shown in more detail in FIG. 5. The protective envelope, in which the drinking straw is covered, is omitted for simplification. The drinking straw carrier 42 is formed by a roller 46. The roller is rotatably journalled on a shaft (not shown) which shaft is firmly attached to the second end 40 of the second portion 19*b* of the applicator arm 19. The roller 46 is secured on the shaft by a conventional locking member, e.g. a washer. The roller 46 is axisymmetric and shaped as a concave cylinder or bobbin. It has two end flanges 48 and a rounded, concave centre 50. The centre 50 of the roller has a varying diameter. The diameter of the centre 50 smoothly decreases from one end flange 48 down to a middle section of the centre 50, where the diameter is constant over a distance, and then the diameter increases again up to the other end flange. The rounded, concave shape hence formed preferably corresponds to the size and diameter of the drinking straw 3. A drinking straw 3 is also shown in FIG. 5 and it can be seen that the roller is formed to fit the drinking straw 3 such that the drinking straw 3 can be carried by means of the concave centre 50 of the roller 46. In the figure it is also seen that an axis R of rotation of the roller 46 is perpendicular to an axis K (best seen in FIG. 7) representing a lengthwise direction of the drinking straw 3. The roller 46 may for example be made of a plastic material, preferably a plastic material that has a low coefficient of friction, is self-lubricated and has a high resistance to abrasion. One example of such material may be a high or ultra high molecular weight polyethylene (HMPE, UHMWPE) or a high performance polyethylene (HPPE). The shaft is for example made of stainless steel or another metallic material.

The drinking straw will be positioned on the wall of the packaging container 17 in a package point 44. The velocity, shown as the arrow denoted $v_c$, of the first conveyor 23 is substantially constant. Hence, the packaging container 17 will move at the same a constant velocity $v_c$ In order to maintain the drinking straw 3 exactly at the package point 44 on the wall of the packaging container, the displacement of the drinking straw carrier 42 of the applicator arm 19 needs to move with the exact same constant velocity. Otherwise the drinking straw will be dragged along the packaging container and the glue will smear. Further, in order for the drinking straw to securely attach to the packaging container, the applicator arm 19 needs to firmly hold the drinking straw 3 by exerting a slight pressure onto the packaging container 17.

Figure 8:
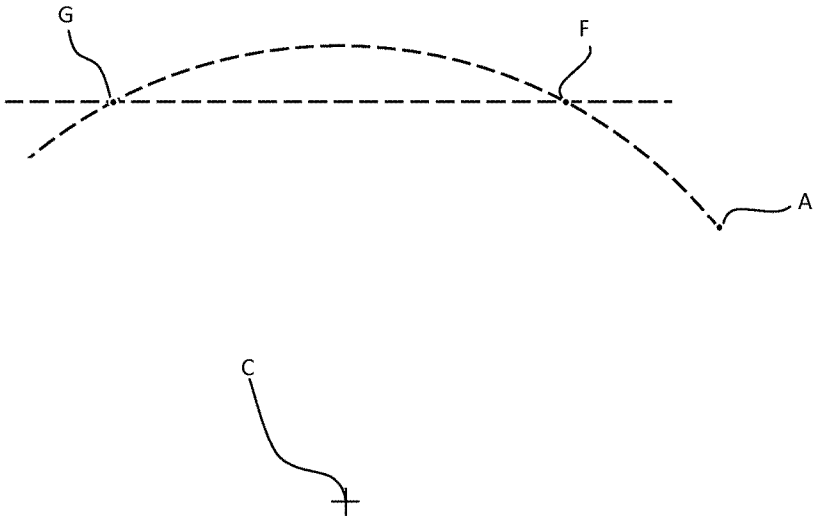
FIG. 8 is a schematic illustration of portions of the motion paths of the application device and the first conveyor.

The pressure is solved in that the eccentric, circular path of at least the end 40 of the application device 16 is at least in theory overlapping the linear path L of the first conveyor 23, from the application position, i.e. first moment of contact between the drinking straw 3 and the packaging container 17, to the leaving position. This is illustrated by FIG. 8. The packaging containers are transported along a line L, whereas the application device 16 is eccentrically moved around the rotation point C, such that the drinking straw carrier 42 is moved along a circular path. However, in practise, when there is a packaging container on the first conveyor 23, and the drinking straw 3 comes into contact with the wall of the packaging container 17 it cannot continue following the circular path, since the packaging container will prevent that. Instead, the packaging container pushes the drinking straw carrier 42, and due to the spring-loaded pivot point D, the second portion 19*b* of the applicator arms 19 rotate clockwise and compress the spring 44. Hence, the holding force, for holding the drinking straw 3 towards the wall of the packaging container 17, is created by the spring 44.

The eccentric circular movement of the application device, as well as the resilience of the second portion 19*b* by means of the spring-loaded pivot point D, will give rise to a varying velocity of the drinking straw carrier 42 between the application position and the leaving position. Accordingly, the drinking straw 3 will not be kept at the package point 44 throughout the movement along line L.

However this has been solved. It has been realised that the variation in velocity have two causes. The first cause is the fact that the application device is eccentrically moved around the rotation point C, the second cause is the fact that the spring changes the movement of the drinking straw carrier.

Figure 6:
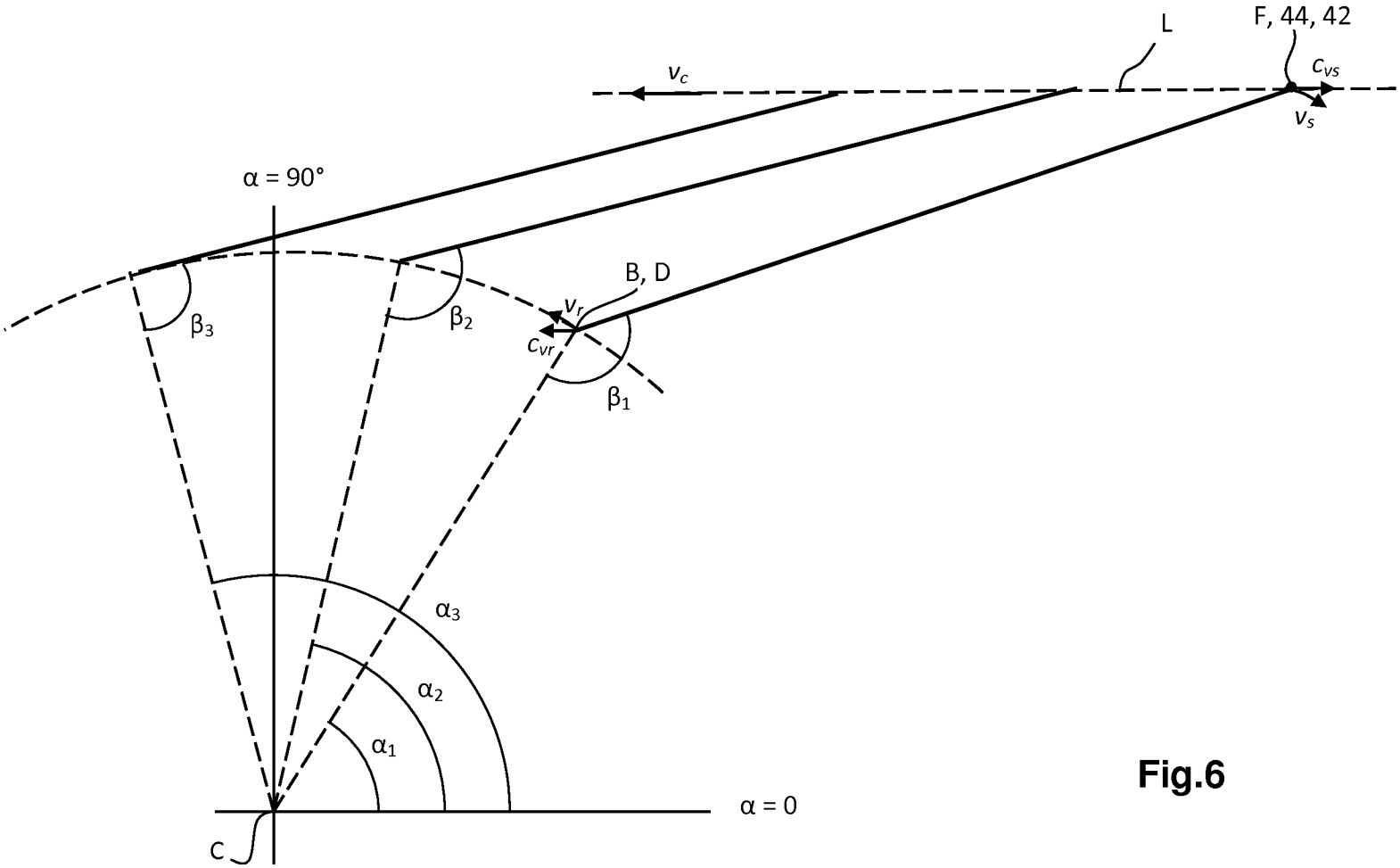
FIG. 6 is a schematic illustration of the outermost portion of the applicator arm, in three positions between an application position and a leaving position.

FIG. 6 shows the outer portion 19*b* of the applicator arm 19 in three different positions. The outer portion 19*b* furthest to the right in the figure illustrates the position of the outer portion 19*b* in the application position. The outer portion 19*b* furthest to the left in the figure illustrates the position of the outer portion 19*b* near the leaving position. Since the base point B of the first portion 19*a* and the pivot point D of the outer portion 19*b* will make the same movement around the rotation point C, only the rotation point C and the pivot point are shown for simplification. During rotation of the servo motor of the drive unit, the pivot point D will be eccentrically moved along the circular path shown as a curved, dashed line. During rotation the pivot point will form a rotational angle $\alpha$ (shown as $\alpha_1$-$\alpha_3$ in FIG. 6) with regard to the rotation point C. When the outer portion 19*b* of the applicator arm 19 rotates around the pivot point D an angle $\beta$ (shown as $\beta_1$-$\beta_3$ in FIG. 6), between the extension of the outer portion 19*b* and an imaginary, dashed line through the rotation point C, will be changed. The reference numeral $v_r$ illustrates the velocity of the movement provided by the servo motor. It can be appreciated that only a horizontal component $c_{vr}$ of said velocity will be aligned with the horizontal velocity $v_c$ of the first conveyor 23. The geometry gives that the horizontal component $c_{vr}$ of $v_r$ will increase as the angle $\alpha$ increases up to 90°. Further, the horizontal component $c_{vr}$ of $v_r$ will decrease again when the angle increase above 90°. At an angle $\alpha$ the horizontal component $c_{vr}$ of the velocity $v_r$ will be equal to the velocity $v_c$ of the packaging container, since there will be no vertical component of the velocity $v_r$. If taking only the above into account, the rotational movement of the servo motor would need to compensate by gradually (or continuously) decrease some from 0° up to 90°, and then increase above 90° to keep the package point 44 aligned with the drinking straw 3 in the drinking straw carrier 42. Hence, the servo motor should be continuously or gradually decelerated up to 90°, and then above 90° be accelerated, such that the horizontal component $c_{vr}$ of $v_r$ is constant. But due to the rotation of the outer portion 19*b* around the pivot point, there is more to take into account. When the outer portion 19*b* of the applicator arm starts rotating around the pivot point D, the angle $\beta$ (shown as $\beta_1$ -$\beta_3$ in FIG. 6) will decrease. The rotation will give rise to a velocity contribution $v_s$ to the drinking straw carrier 42, which will have a horizontal component $c_{vs}$ directed opposite the velocity $v_c$ of the packaging container. The horizontal component $c_{vs}$ of the velocity $v_s$ will decrease as the angle $\beta$ decreases until the angle $\alpha$ is 90°. The angles $\alpha$ and $\beta$ are related. At an angle a above 90° the horizontal component $c_{vs}$ of the velocity $v_s$ will instead increase. If taking only the rotation around the pivot point D into account, the rotational movement of the servo motor would need to compensate by gradually (or continuously) increase from angle $\alpha$=0° up to 90°, and then decrease above 90° to keep the package point 44 aligned with the drinking straw 3 in the drinking straw carrier 42.

Calculations have shown that the horizontal component $c_{vr}$ of the rotation velocity $v_r$ will be larger than the horizontal component $c_{vs}$ of the velocity $v_s$ round the pivot point D. Hence, the net effect is that the servo motor of the drive unit needs to compensate by decelerating at least at the application position F, preferably start decelerating before the application point F and continue some time after passing the application position F. Further, upon leaving the drinking straw 3, at least at the leaving position G, the servo motor needs to compensate by accelerating.

In other words, the drinking straw carrier 42 can be moved from the application position F to the leaving position G, maintaining a velocity in the packaging container moving direction, being equal to the constant velocity $v_c$ of the first conveyor 23. This is accomplished by accelerating the rotational velocity $v_r$ of the drive unit to compensate such that the net balance of the velocity components $c_{vr}$, $c_{vs}$, in the packaging container moving direction, of the eccentric rotation round the rotation point C and the rotation of at least the outer portion 19*b* of the applicator arm 19 around the pivot point D, is at all times equal to the constant velocity $v_c$.

The decelerating and the accelerating of the servo motor will have to be adjusted to the conditions of each specific apparatus and to the exactness needed.

In the previous it has been described how the drinking straw 3, by servo motor compensation, is kept at the same position on the wall of the packaging container, in relation to the conveying direction. With regard to FIG. 7 it will now be described how a movement of the drinking straw will be prevented also in a lengthwise direction of the straw. As has been described in relation to FIG. 2 the drive means 1, the application device 16, the separation device 8 and the associated servo motors (shown as the box 24 in FIG. 2) are inclined in relation to the conveyor 23. Hence, as seen in FIG. 7, the drinking straws 3 will be positioned with an angle $\theta$ on the side wall of the packaging container 17, and the applicator arms 19 will therefore, in reality, move along a lengthwise direction of the drinking straws between the application position F and the leaving position G. The direction of movement of the conveyor 23 is illustrated by the arrow S.

As mentioned the applicator arms 19 will follow the lengthwise direction of the drinking straws, i.e. follow the earlier described axis K, from the application position F to the leaving position G. The rollers 46, each having a rotation axis R being perpendicular to the axis K, will roll along the drinking straw 3 in contact with the protective envelope 52. The shaft and the roller 46 are designed such that the friction between the shaft and the roller is less than the friction between the protective envelope 52 and an outer contact surface of the roller 46. Further, the friction between the protective envelope 52 and the outer contact surface of the roller 46 should be designed such that it is less than the friction between the protective envelope 52 and the wall of the packaging container 17. In this way it is secured that the roller 46 will start rotating upon contacting the drinking straw 3 (i.e. the envelope 52). Hence, a displacement of the drinking straw with envelope, in relation to the packaging container, is prevented, also in the lengthwise direction of the drinking straw. Hence, it can be secured that the drinking straw 3 will be kept exactly at the previously described package point 44.

It is to be understood that the glue or adhesive used will highly influence the friction between the packaging container wall and the drinking straw with envelope.

From the application position F to the leaving position G the rollers 46 will roll a distance of approximately a few millimeters on the packaging container.

Figure 9:
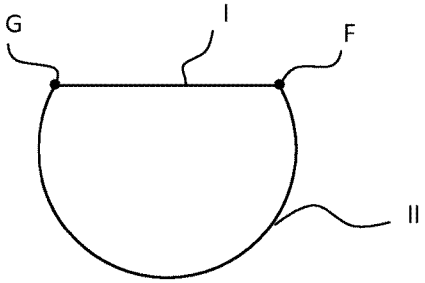
FIG. 9 is the actual motion cycle of the drinking straw carrier of the application device.

So far the motion of the application device from a picking position A to a leaving position G has been described. However, that is only a portion of the entire motion cycle performed by the application device 16 per drinking straw application. The entire motion cycle can be divided into two portions. In a first portion I, shown in FIG. 9, of a motion cycle the applicator arms 19 are moved from the application position F, in which they apply a straw, to the leaving position G, in which they leave said drinking straw on the packaging container. Said first portion I of the motion cycle is equal for successive packaging containers on the first conveyor 23, i.e. the first portion I is "static", i.e. it will not change from one packaging container to another during operation of the apparatus.

In a second portion II of the motion cycle the applicator arms 19 move from the leaving position G back to the application position F to apply a drinking straw onto a successive packaging container. The second portion II includes passing the picking position A such that the applicator arm can pick a successive drinking straw from the drive means 1, i.e. the drinking straw feed wheel, and carry it to the application position F. Said second portion II, unlike the first portion I, varies between packaging containers. Hence, it is "dynamic" in the sense that it is adjusted to fit the pitch P between successive packaging containers 17 on the first conveyor 23. In an ideal case the pitch P to the successive packaging container 17 is equal to the set point pitch value $P_s$. If the pitch P to a successive packaging container is shorter than the set point pitch value $P_s$, the motion from the leaving position G back to the application position F needs to be performed faster than for the set point pitch value $P_s$. If, on the other hand, the pitch to a successive packaging container is instead longer than the set point pitch value $P_s$, the motion back needs to be performed slower. The transition from the second portion II to the first portion I, at the application position F, is made such that the rotational velocity $v_r$ provided by the servo motor in the drive unit is equal to an application velocity $v_a$ and the acceleration is equal to an application acceleration $a_a$. The application velocity $v_a$ and the application acceleration $a_a$ will be the same for all successive packaging containers, i.e. for each motion cycle. The transition from the first portion I to the second portion II, at the leaving position G, is made such that the rotational velocity $v_r$ provided by the servo motor in the drive unit is equal to a leaving velocity $v_1$ and the acceleration is equal to a leaving acceleration $a_1$. The leaving velocity $v_1$ and the leaving acceleration $a_1$ will be the same for all successive packaging containers, i.e. for each motion cycle.

The application acceleration $a_a$ is the acceleration needed in the application position F such that the drinking straw carrier 42 can be moved with a velocity equal to the velocity $v_c$ of the first conveyor 23. Hence, the acceleration compensates, in that moment, such that the net balance of velocity components $c_{vr}$, $c_{vs}$, in the packaging container moving direction, of the eccentric rotation round the rotation point C and the rotation of at least the outer portion 19*b* of the applicator arm 19 around the pivot point D, is equal to the constant velocity $v_c$. The application velocity $v_a$ is such that the component of it, in the direction of the packaging container movement, is equal to the packaging container velocity $v_c$, i.e. equal to the velocity of the first conveyor 23.

The leaving acceleration $a_1$ is the acceleration needed in the leaving position G such that the drinking straw carrier 42 can be moved with a velocity equal to the velocity $v_c$ of the first conveyor 23. Hence, the acceleration compensates, in that moment, such that the net balance of velocity components $c_{vr}$, $c_{vs}$, in the packaging container moving direction, of the eccentric rotation round the rotation point C and the rotation of at least the outer portion 19*b* of the applicator arm 19 around the pivot point D, is equal to the constant velocity $v_c$. The leaving velocity $v_1$ is such that the component of it, in the direction of the packaging container movement, is equal to the packaging container velocity $v_c$, i.e. equal to the velocity of the first conveyor 23.

The key to accomplish a smooth operation is to limit abrupt or considerable accelerations. Any change in acceleration will be made as smooth as possible, as sudden acceleration changes will cause unnecessary vibrations to the apparatus 100 and strains in the servo motors of the drive unit. Hence, if detecting a pitch P between two successive packaging containers 17 which is shorter than a set point pitch value $P_s$, the second portion II of the motion cycle will be adapted by smoothly accelerating from the leaving velocity $v_1$ and the leaving acceleration $a_1$ and then smoothly decelerating such that, at the application position F, the application velocity $v_a$ and the application acceleration $a_a$ have been reached. Similarly, if detecting a pitch P between two successive packaging containers 17 which is longer than a set point pitch value $P_s$, the second portion II of the motion cycle will be adapted by smoothly decelerating from the leaving velocity $v_1$ and then smoothly accelerating such that, at the application position F, the application velocity $v_a$ and the application acceleration $a_a$ have been reached.

The adaptation of the second portion II of the motion cycle is made by the previously described control device, which control device is connected to the drive unit driving the drive means 1 and the application device 16.

Figure 10:
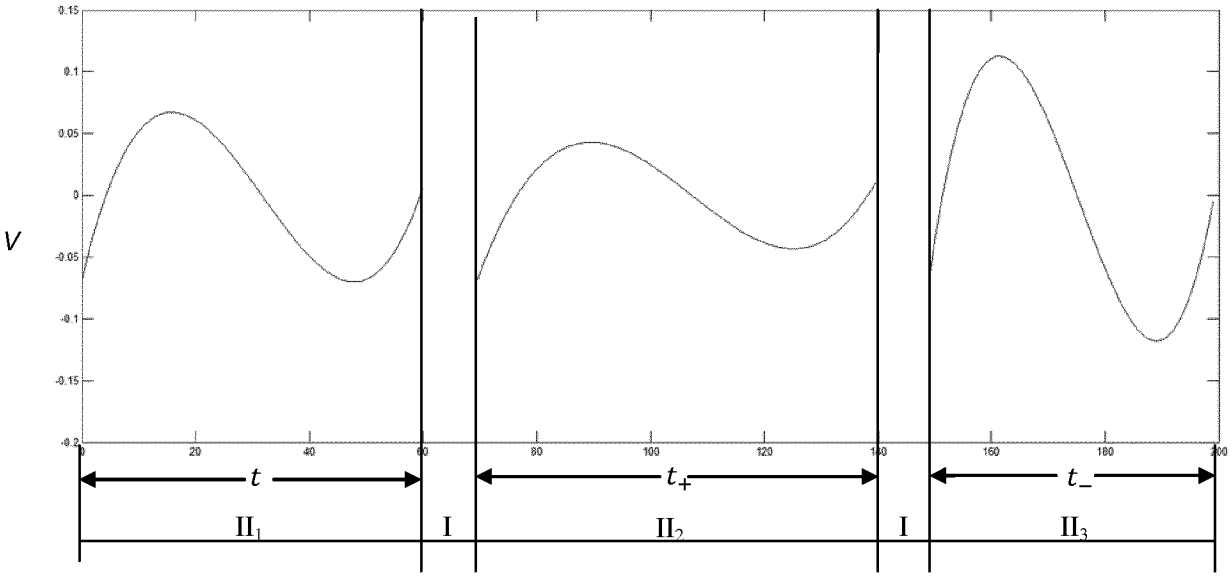
FIG. 10 is a graph illustrating time and velocity for motion cycles made by the application device.

FIG. 10 shows a graph of time and velocity for an illustrative, exemplary operation of the application device 16. Three different "dynamic" second portions $II_1$, $II_2$ and $II_3$ are shown with "static" first portions I indicated there between. The velocity in the first portions I is not shown, and was previously described in detail. In a first second portion $II_1$, to the left in the figure, the pitch P is equal to the set point pitch value $P_s$, and the time is t. The velocity will start at the application velocity $v_a$, increase and then decrease, and end at the leaving velocity $v_1$. In the second, second portion $II_2$ the pitch P is longer than the set point pitch value $P_s$ and the time for this second portion $II_2$ is thereby increased to $t_+$. Since the available time frame is longer, the velocity variation can be made less steep. Still, the velocity will start at the application velocity $v_a$, increase and then decrease, and end at the leaving velocity $v_1$. In the third, second portion $II_3$ the pitch P is shorter than the set point pitch value $P_s$, and the available time is shorter; t. The velocity will still start at the application velocity $v_a$, increase and then decrease, and end at the leaving velocity $v_1$. However, a steeper velocity variation, than in the previous two second portions $II_1$, $II_2$, is needed since the time is shorter.

The present invention should not be considered as restricted to the embodiment described above and shown in the drawings. It is apparent for a person skilled in the art that many modifications are being conceivable without departing from the scope of the appended claims.

For example, an apparatus according to the present invention may instead be employed for applying other objects such as, for example, spoons or the like which are intended to accompany the package 17 to the consumer.

In the embodiment described each applicator arm 19 comprises two portions 19*a*, 19*b*, where the outermost piece is being rotatably journalled in the other in the pivot point D. The rotation in the pivot point D is springloaded by means of a compression spring 44 in order to apply a force towards the packaging container for holding the drinking straw firmly on the wall. Alternatively, each applicator arm 19 is manufactured as one piece. The base point B is then provided also with the pivoting function. The base point is then springloaded with a torsion spring to be able to apply force onto the packaging container 17.

The invention claimed is:

1. Apparatus for applying drinking straws to packaging containers, said apparatus (100) comprises:

a drive unit adapted for conveying drinking straws wrapped in protective envelopes to a picking position, a first conveyor adapted for conveying packaging containers, at a substantially constant velocity, along a packaging container moving direction, and an application device which comprises at least one applicator arm, which applicator arm comprises a drinking straw carrier adapted to carry a drinking straw, said at least one applicator arm is adapted to pick a drinking straw from the drive unit at the picking position and carry, with the drinking straw carrier, the drinking straw to an application position where the drinking straw is adapted to come into contact with a wall of the packaging container, and further to a leaving position where the at least one applicator arm leaves the drinking straw on the packaging container, wherein the drinking straw carrier is adapted to keep the drinking straw towards the wall of the packaging container while moving along a lengthwise direction of the drinking straw, from the application position to the leaving position, and the drinking straw carrier comprises a rotatable roller having an axis of rotation arranged substantially perpendicular to the lengthwise direction of the drinking straw, which roller is adapted to rotate in contact with the protective envelope and drinking straw.

2. Apparatus according to claim 1, wherein the roller is rotatably journalled on a shaft of the applicator arm and adapted to rotate due to friction from the protective envelope and drinking straw.

3. Apparatus according to claim 2, wherein friction between the shaft and the roller is adapted to be less than friction between the protective envelope and an outer contact surface of the roller, wherein the friction between the protective envelope and the outer contact surface of the roller is less than between the protective envelope and the wall of the packaging container, such that the roller is adapted to start rotating upon contacting the envelope and drinking straw, and such that the drinking straw will not be displaced in relation to the packaging container .

4. Apparatus according to claim 1, wherein the roller is made of a plastic material with a low coefficient of friction and a high resistance to abrasion.

5. Apparatus according to claim 1, wherein the roller is shaped as an axisymmetric, concave cylinder adapted to carry the drinking straw with a concave centre bounded by two end flanges.

6. Apparatus according to claim 1, wherein the at least one applicator arm has a base end point arranged for eccentric, substantially circular rotation round a rotation point, the rotation point being connected to a drive unit adapted to provide a rotational velocity, wherein the applicator arm comprises a spring-loaded pivot point around which at least an outer portion of the applicator arm can rotate, said outer portion comprising the drinking straw carrier, wherein the application device and the first conveyor are arranged such in relation to each other that, upon application of the drinking straw towards the wall of the packaging container, at the application position, the outer portion of the applicator arm will be forced to rotate around the spring-loaded pivot point thereby creating a force pushing the drinking straw towards the wall of the packaging container.

7. A method for applying drinking straws to packaging containers, said method comprises:

conveying drinking straws wrapped in protective envelopes to a picking position by a drive unit, conveying the packaging containers by a first conveyor at a substantially constant velocity, along a packaging container moving direction, picking a drinking straw with envelope from the drive unit at the picking position, where the picking is done by an application device, which comprises at least one applicator arm, which applicator arm comprises a drinking straw carrier adapted to carry a drinking straw, carrying the drinking straw, with the drinking straw carrier, to an application position where the drinking straw is adapted to come into contact with a wall of the packaging container, and further to a leaving position where the at least one applicator arm leaves the drinking straw on the packaging container, keeping the drinking straw towards the wall of the packaging container, while moving the drinking straw carrier, along a lengthwise direction of the drinking straw, from the application position to the leaving position, said drinking straw carrier being a rotatable roller having an axis of rotation arranged substantially perpendicular to the lengthwise direction of the drinking straw and said roller being arranged to rotate in contact with the drinking straw.

8. Method according to claim 7, wherein the at least one applicator arm has a base end point arranged for eccentric, substantially circular rotation round a rotation point, the rotation point being connected to a drive unit adapted to provide a rotational velocity, wherein the applicator arm comprises a spring-loaded pivot point around which at least an outer portion of the applicator arm can rotate, said outer portion comprises the drinking straw carrier, wherein the application device and the first conveyor are arranged such that, in relation to each other, upon application of the drinking straw towards the wall of the packaging container, at the application position, the outer portion of the applicator arm will be forced to rotate around the spring-loaded pivot point, thereby creating a force pushing the drinking straw towards the wall of the packaging container, wherein said method further:

moving the drinking straw carrier from the application position to the leaving position, in the packaging container moving direction, maintaining a velocity in the packaging container moving direction as being equal to the constant velocity of the first conveyor, thereby keeping the drinking straw at the same position on the wall of the packaging container, by accelerating or decelerating the rotational velocity of the drive unit to compensate for changes in velocity of the drinking straw carrier, in the packaging container moving direction, due to a changing velocity component, in the packaging container moving direction, of the eccentric rotation round the rotation point and the rotation of at least the outer portion of the applicator arm around the pivot point.

9. An apparatus for applying drinking straws to packaging containers, the apparatus comprising:

a drive unit configured to convey drinking straws, each wrapped in a protective envelope, to a picking position;

a first conveyor configured to convey, at a substantially constant velocity, packaging containers along a packaging container moving direction; and an application device that further includes:

a drinking straw carrier configured to carry a respective drinking straw;

an applicator arm configured to pick the respective drinking straw from the drive unit at the picking position and carry the respective drinking straw and the drinking straw carrier to: (1) an application position at which the respective drinking straw is adapted to come into contact with a wall of a respective packaging container, and (2) a leaving position at which the applicator arm leaves the respective drinking straw on the respective packaging container, wherein the drinking straw carrier is configured to keep the respective drinking straw towards the wall of the respective packaging container as the drinking straw carrier moves along a lengthwise direction of the drinking straw, from the application position to the leaving position, and wherein the drinking straw carrier further includes:

a rotatable roller, having an axis of rotation arranged substantially perpendicular to the lengthwise direction of the respective drinking straw, that is configured to rotate in contact with the respective drinking straw and corresponding protective envelope.

* * * * *